US006501225B1

(12) United States Patent
Konopka

(10) Patent No.: US 6,501,225 B1
(45) Date of Patent: Dec. 31, 2002

(54) BALLAST WITH EFFICIENT FILAMENT PREHEATING AND LAMP FAULT PROTECTION

(75) Inventor: John G. Konopka, Deer Park, IL (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/923,037

(22) Filed: Aug. 6, 2001

(51) Int. Cl.[7] ..... H05B 37/02
(52) U.S. Cl. ..... 315/105; 315/106; 315/225
(58) Field of Search ..... 315/105, 106, 315/107, 224, 225

(56) References Cited

U.S. PATENT DOCUMENTS 5,144,195 A 9/1992 Konopka et al.
5,656,891 A 8/1997 Luger et al.
5,973,455 A 10/1999 Mirskiy et al.
5,998,930 A 12/1999 Upadhyay et al.

*Primary Examiner*—David Hung Vu
(74) *Attorney, Agent, or Firm*—Kenneth D. Labudda

(57) ABSTRACT

A ballast (10) for powering a gas discharge lamp (20) having heatable filaments (22,24) includes a filament heating and protection circuit (300) that provides preheating of the filaments, efficiently reduces the filament heating power after the lamp ignites, quickly responds to removal or failure of the lamp in order minimize power dissipation in the ballast, and operates a replaced lamp without requiring cycling of the power to the ballast. In a preferred embodiment, filament heating and protection circuit (300) includes a transformer (400), a switching circuit (600), a turn-on circuit (700), and a lamp-out detection circuit (800).

20 Claims, 5 Drawing Sheets

BALLAST WITH EFFICIENT FILAMENT PREHEATING AND LAMP FAULT PROTECTION

FIELD OF THE INVENTION

The present invention relates to the general subject of circuits for powering discharge lamps. More particularly, the present invention relates to ballast that efficiently preheats the lamp filaments and that inherently provides lamp fault protection.

BACKGROUND OF THE INVENTION

Electronic ballasts for gas discharge lamps are often classified into two groups according to how the lamps are ignited—preheat and instant start. In preheat ballasts, the lamp filaments are preheated at a relatively high level (e.g., 7 volts peak) for a limited period of time (e.g., one second or less) before a moderately high voltage (e.g., 500 volts peak) is applied across the lamp in order to ignite the lamp. In instant start ballasts, the lamp filaments are not preheated, so a higher starting voltage (e.g., 1000 volts peak) is required in order to ignite the lamp. It is generally acknowledged that instant start operation offers certain advantages, such as the ability to ignite the lamp at a lower ambient temperatures and greater energy efficiency (i.e., light output per watt) due to no expenditure of power on filament heating during normal operation of the lamp. On the other hand, instant start operation usually results in considerably lower lamp life than preheat operation.

Because a substantial amount of power is unnecessarily expended on heating the lamp filaments during normal operation of the lamp, it is desirable to have preheat ballasts in which filament power is minimized or eliminated once the lamp has ignited. Currently, there are at least three main approaches for achieving this goal. A first approach, which may be called the "passive" method, heats the filaments via windings on a transformer that also provides the high voltage for igniting the lamp. An acknowledged drawback of this approach is a limit on the degree to which filament heating power may be reduced once the lamp ignites and begins to operate; a detailed discussion of the difficulties with this approach is provided in the "Background of the Invention" section of U.S. Pat. No. 5,998,930, the relevant portions of which are incorporated herein by reference.

A second approach, which is common in so-called "programmed start" products, employs an inverter that is operated at one frequency in order to preheat the lamp filaments, then "swept" to another frequency in order to ignite and operate the lamp. Because this approach is difficult and/or costly to implement in ballasts having self-oscillating type inverters, it is usually employed only in ballasts having driven type inverters. This approach has the further disadvantage of producing a significant amount of "glow current" through the lamp immediately prior to ignition. Glow current is generally considered to negatively impact the useful life of the lamp.

A third approach employs switching circuitry that disconnects the source of filament power from each of the filaments after the lamp ignites. This approach tends to be rather costly to implement, especially in ballasts that power multiple lamps because multiple switching circuits are required (i.e., one for each filament or each pair of parallel-connected filaments).

All of the aforementioned approaches are largely limited in function to filament heating and do not provide any separate benefits, such as automatic relamping capability or prevention of the high voltages, currents, and power dissipation that generally occurs following lamp removal or failure. Because ballasts that implement these approaches generally require separate, dedicated circuitry in order to accommodate relamping and protect the ballast from damage due to lamp removal or failure, the resulting ballasts tend to be functionally and structurally complex.

What is needed, therefore, is a ballast in which: (i) the filaments are properly preheated prior to lamp ignition; (ii) little or no power is expended on filament heating during normal operation of the lamp; and (iii) little or no pre-ignition glow current occurs. A need also exists for a filament heating reduction approach that is readily implemented in ballasts having either driven or self-oscillating inverters. A further need exists for a filament heating reduction approach that accommodates relamping and that provides lamp fault protection without requiring extensive additional circuitry. A ballast with these attributes would represent a significant advance over the prior art.

DETAILED DESCRIPTION OF THE PREFERRED EMBODIMENTS

Figure 1:
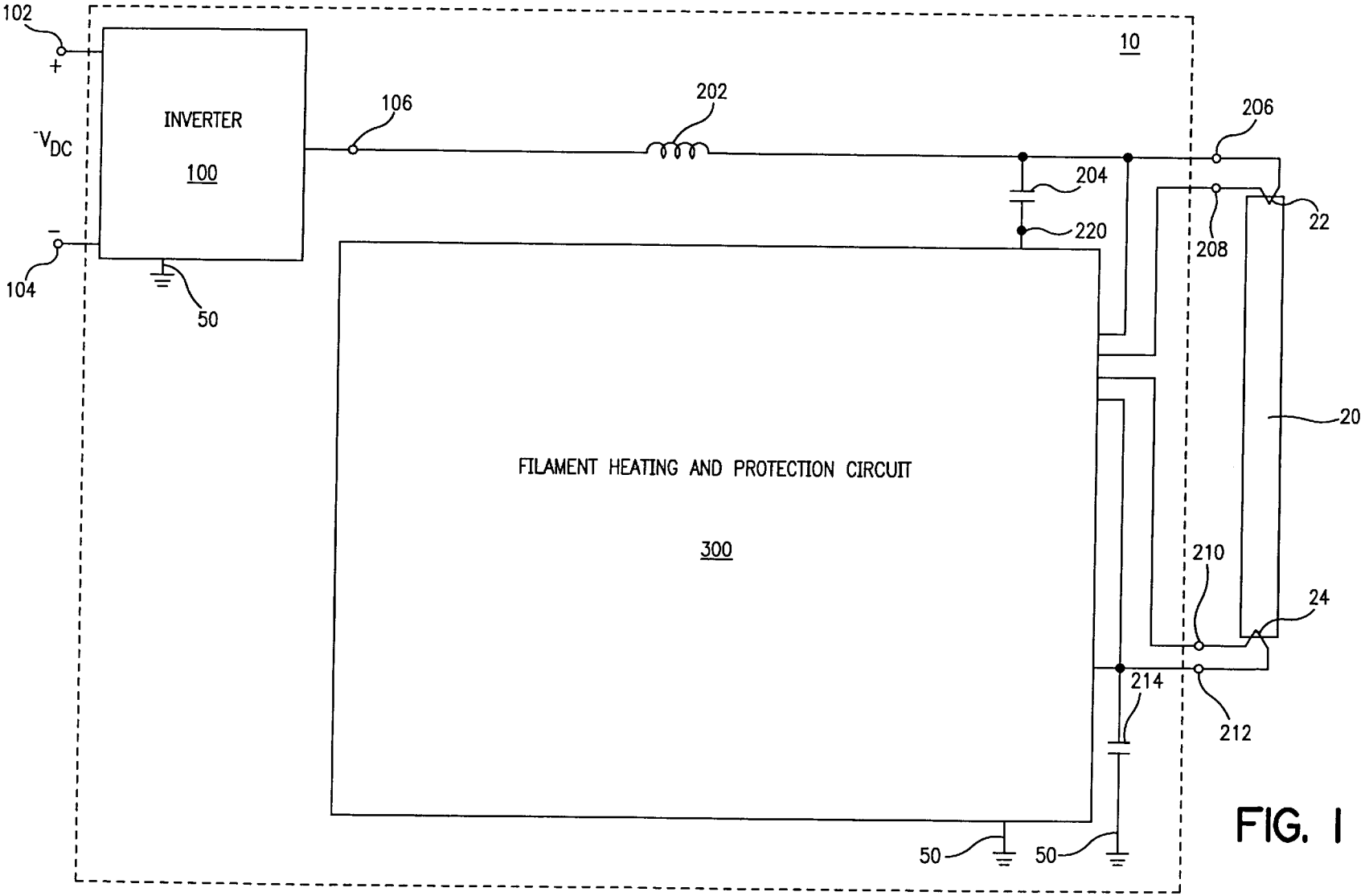
FIG. 1 is a partial block-diagram schematic of a ballast that includes a filament heating and protection circuit, in accordance with the present invention.

FIG. 1 describes a ballast 10 for powering at least one gas discharge lamp 20 having heatable filaments 22,24. Ballast 10 includes an inverter 100, output connections 206,208, 210,212, a resonant inductor 202, a resonant capacitor 204, a direct current (DC) blocking capacitor 214, and a filament heating and protection circuit 300.

Inverter 100 has a pair of inputs 102,104 and an output 106. During operation, inverter 100 receives a substantially direct current (DC) voltage, $V_{DC}$, and provides an alternating voltage at inverter output 106. Preferably, $V_{DC}$ is a substantially direct current (DC) voltage that may be provided, for example, via a rectifier and boost converter arrangement that receives conventional AC voltage (e.g., 120 Vrms at 60 Hz) and provides a desired DC voltage (e.g., 350 volts). The alternating voltage at inverter output 106 has a high frequency (e.g., 20,000 hertz or greater) that is at or near to the natural resonant frequency of inductor 202 and capacitor 204. Output connections 206,208,210,212 are adapted for connection lamp 20, wherein first and second output connections 206,208 are coupled to a first filament 22 of lamp 20, and third and fourth output connections 210,212 are coupled to a second filament 24 of lamp 20. Resonant inductor 202 is coupled between inverter output 106 and first output connection 206. Resonant capacitor 204 is coupled between first output connection 206 and a first node 220. DC blocking capacitor 214 is coupled between fourth output connection 212 and circuit ground 50.

Filament heating and protection circuit 300 is coupled to first node 220 and output connections 206,208,210,212. Filament heating and protection circuit 300 provides a number of different modes of operation, including a filament preheating mode, an ignition mode, a normal operating mode, and a fault mode. During the filament preheating mode, the voltage ($V_{FIL}$) across each filament 22,24 is maintained at a preheat level (e.g., 7 volts peak) and the voltage ($V_{LAMP}$) applied to the lamp (e.g., the voltage between the first and fourth output connections 206, 212) is maintained at a pre-ignition level (e.g., 175 volts peak) in order to preheat the filaments prior to attempting to ignite the lamp. During the ignition mode, $V_{LAMP}$ is increased to an ignition level (e.g., 1000 volts peak) that is greater than the pre-ignition level (e.g., 175 volts peak) in order to ignite the lamp. During the normal operating mode, $V_{FIL}$ is maintained at an operating level (e.g., 0.5 volts peak) that is substantially less than the preheat level (e.g., 7 volts peak) in order to conserve power expended on heating the filaments. During the fault mode, the filament preheating mode and the ignition mode are repeated in response to a lamp fault condition. Preferably, a lamp fault condition is deemed to have occurred when the lamp is disconnected and/or when the lamp fails to conduct current following completion of the ignition mode.

Figure 2:
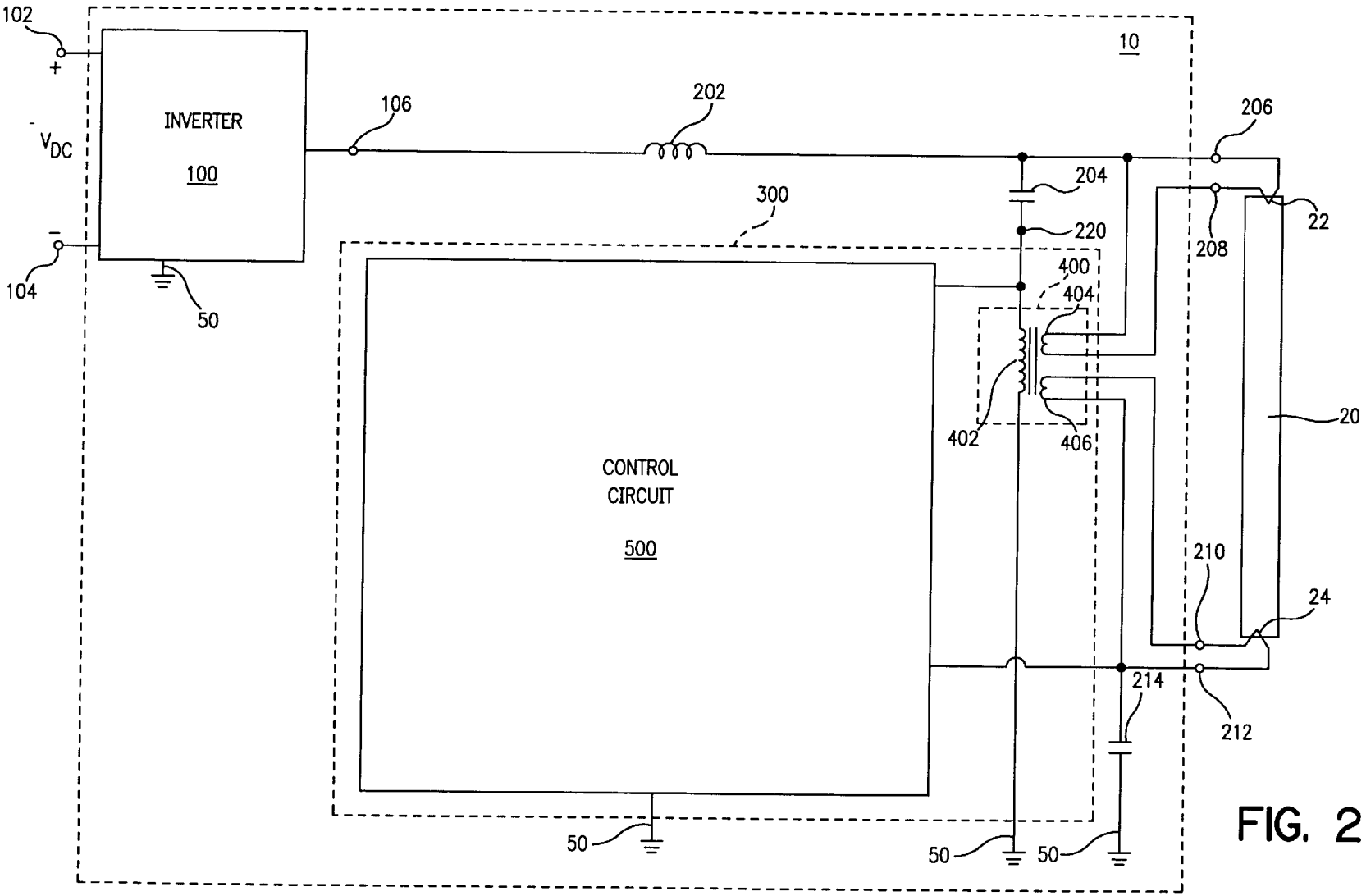
FIG. 2 describes a preferred arrangement for the filament heating and protection circuit referred to in FIG. 1, in accordance with a preferred embodiment of the present invention.

Turning now to FIG. 2, filament heating and protection circuit 300 preferably includes a transformer 400 and a control circuit 500.

Transformer 400 includes a primary winding 402, a first auxiliary winding 404, and a second auxiliary winding 406. Primary winding 402 is coupled between first node 220 and circuit ground 50. First auxiliary winding 404 is coupled to first and second output connections 206,208. Second auxiliary winding 406 is coupled to third and fourth output connections 210,212.

Control circuit 500 is coupled to first node 220, fourth output connection 212, and circuit ground 50. During operation, control circuit 500 selectively provides a low impedance alternating current (AC) path between first node 220 and circuit ground 50. More specifically, the low impedance AC path is provided during the ignition and normal operating modes, but not during the filament preheating mode. The low impedance AC path provided by control circuit 500 has an impedance that, for the high frequency current that flows through resonant inductor 202 and resonant capacitor 204, is substantially less than the impedance of primary winding 402. Thus, control circuit 500 effectively shunts the current that normally flows through primary winding 402 to circuit ground 50 during the ignition and normal operating modes, so that a high voltage is developed for igniting the lamp (by virtue of resonant capacitor 204 having a low impedance path to circuit ground 50) and filament power is substantially eliminated during normal operation of the lamp.

Figure 3:
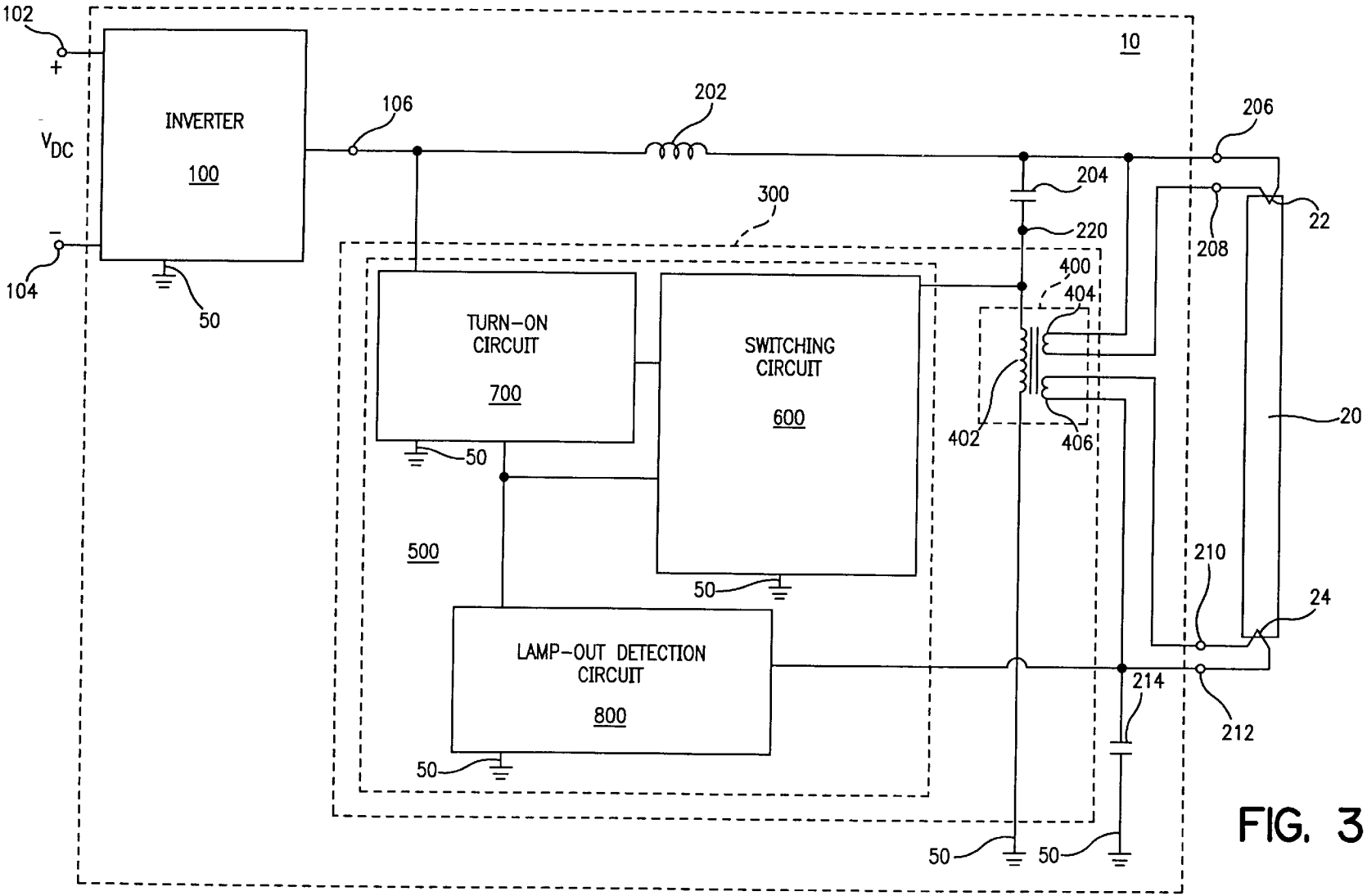
FIG. 3 describes a preferred arrangement for the control circuit referred to in FIG. 2, in accordance with a preferred embodiment of the present invention.

As described in FIG. 3, in a preferred embodiment, control circuit 500 includes a switching circuit 600, a turn-on circuit 700, and a lamp-out detection circuit 800. Switching circuit 600 is coupled between first node 220 and circuit ground 50. Switching circuit 600 is functional to selectively turn on and provide a low impedance AC path between first node 220 and circuit ground 50. Turn-on circuit 700 is coupled to switching circuit 600, and is operable to turn switching circuit 600 on during the ignition mode following completion of the preheating mode. Lamp-out detection circuit 800 is coupled to switching circuit 600 and fourth output connection 212. Lamp-out detection circuit 800 keeps switching circuit 600 on during the normal operating mode, and turns switching circuit 600 off in the event of a lamp fault condition.

Figure 4:
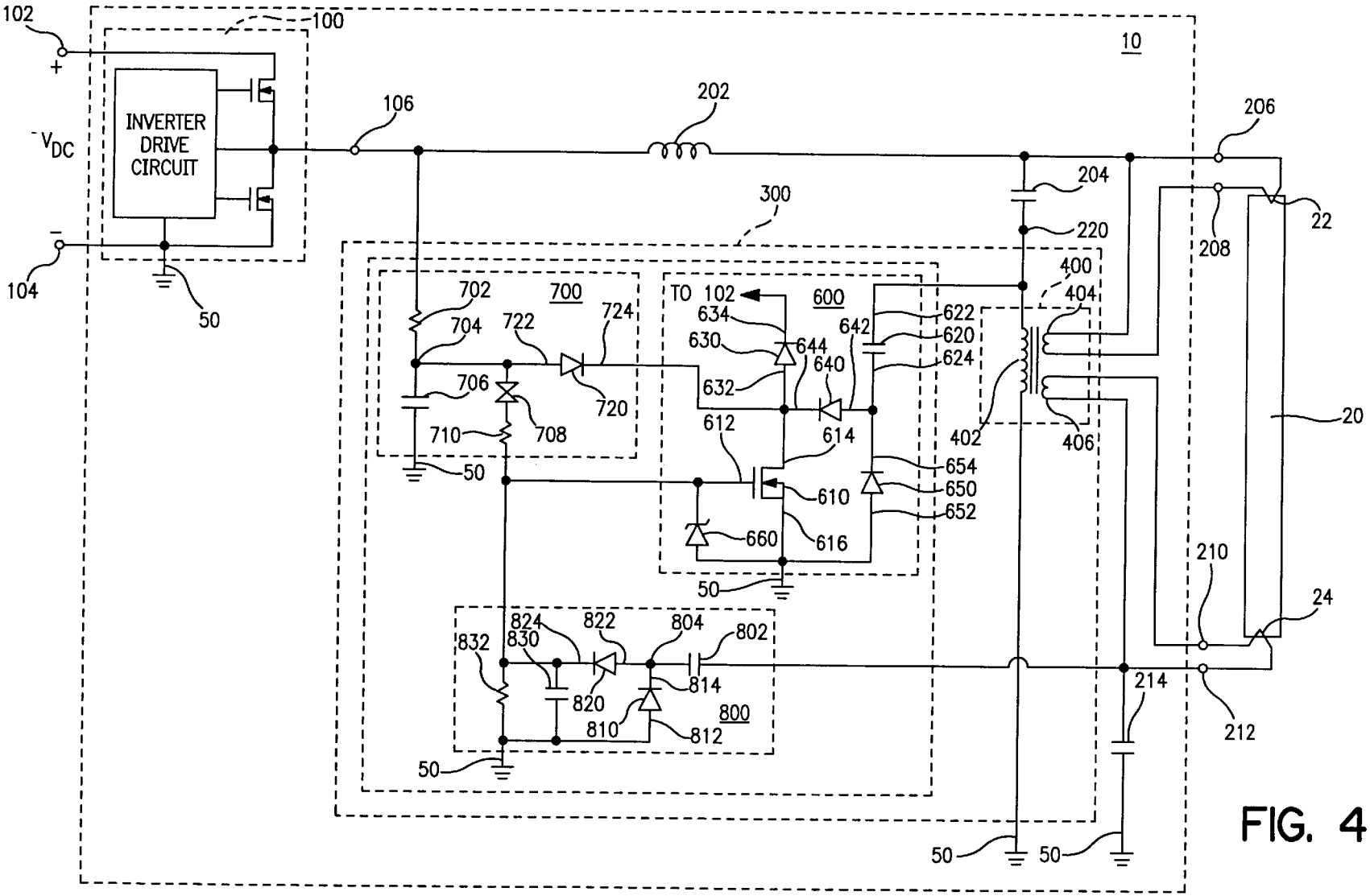
FIG. 4 describes preferred arrangements for the switching circuit, turn-on circuit, and lamp-out detection circuit referred to in FIG. 3, in accordance with a preferred embodiment of the present invention.

Switching circuit 600, turn-on circuit 700, and lamp-out detection circuit 800 are preferably realized as described in FIG. 4. Switching circuit 600 includes a switch 610 having a control terminal 612, a first conduction terminal 614, and a second conduction terminal 616. First conduction terminal 614 is indirectly coupled to first node 220, and second conduction terminal 616 is coupled to circuit ground 50. As described in FIG. 4, switch 610 is preferably implemented as a field-effect transistor (FET) having a drain terminal (corresponding to first conduction terminal 614), a source terminal (corresponding to second conduction terminal 616), and a gate terminal (corresponding to control terminal 612). Switching circuit further includes a capacitor 620 having a first end 622 coupled to first node 220 and a second end 624 coupled to drain terminal 614 of FET 610. Capacitor 620 serves two functions that are relevant when switch 610 is implemented using a FET. First, during periods when switch 610 is on, capacitor 620 functions as a low impedance AC coupling capacitor for coupling first node 220 to circuit ground. Second, during periods when switch 610 is off (i.e., during filament preheating), capacitor 620 functions as a DC blocking capacitor which ensures symmetry (i.e., no significant DC component) in the voltage across primary winding 402.

Switching circuit 600 and transformer 400 provide two main functional benefits. First, they function as a filament "cut-out" circuit that preheats the lamp filaments at a relatively high level for a limited period of time, and then dramatically reduces the filament power in order to operate the lamp in an energy-efficient manner. Second, switching circuit 600 and transformer 400 serve as part of a lamp fault protection circuit that prevents sustained high voltages and currents, and minimizes power dissipation, following removal or failure of the lamp.

Switching circuit preferably further includes a clamp diode 630 having an anode 632 coupled to drain terminal 614 of FET 610, and a cathode 634 coupled to a first input 102 of inverter 100. Clamp diode 630 prevents the voltage at drain terminal 614 from exceeding the inverter input voltage, $V_{DC}$ (e.g., 350 volts), thereby allowing FET 610 to be realized by a device with a reasonable drain-to-source voltage rating (e.g., 400 volts). In the absence of clamp diode 630, the voltage rating of FET 610 would have to be considerably greater and, consequently, FET 610 would be more costly.

Lamp-out detection circuit 800 preferably includes a first capacitor 802, a first diode 810, a second diode 820, a second capacitor 830, and a resistor 832. First capacitor 802 is coupled between fourth output connection 212 and a second node 804. First diode 810 has an anode coupled to circuit ground 50 and a cathode 814 coupled to second node 804. Second diode 820 has an anode 822 coupled to second node 804 and a cathode 824 coupled to gate terminal 612 of FET 610. Second capacitor 830 and resistor 832 are each coupled between gate terminal 612 of FET 610 and circuit ground 50. With an appropriate choice of component values, lamp-out detection circuit 800 is capable of turning switching circuit 600 off within less than one millisecond after occurrence of a lamp fault condition. This response time is significantly faster than prior art approaches, and is attributable to the fact that lamp-out detection circuit 800 is capacitively coupled to output connection 212, which allows lamp-out detection circuit 800 to monitor lamp current rather than the DC voltage across DC blocking capacitor 214. In order to ensure a fast response, it is preferred that the capacitance of capacitor 802 be at least an order of magnitude smaller than that of DC blocking capacitor 214.

The operation and advantages of lamp-out detection circuit 800 is described in greater detail in the present inventor's copending U.S. patent application entitled "Ballast with Fast-Responding Lamp-Out Detection Circuit" (filed on the same day and assigned to the same assignee as the present application).

Turn-on circuit 700 preferably includes a first resistor 702, a capacitor 706, a voltage-triggered device 708, a second resistor 710, and a diode 720. First resistor 702 is coupled between inverter output 106 and a third node 704. Capacitor 706 is coupled between third node 704 and circuit ground 50. Voltage-triggered device 708, preferably implemented as a diac, is coupled between third node 704 and gate terminal 612 of FET 610. Second resistor 710 is interposed between diac 708 and gate terminal 612 of FET 610. Diode 720 has an anode 722 coupled to third node 704 and a cathode 724 coupled to gate terminal 612 of FET 610.

When inverter 100 begins to operate after power is applied to ballast 10, a substantially squarewave voltage that varies between zero and $V_{DC}$ is present at inverter output 106. Capacitor 706 begins to charge up via resistor 702. Approximately one second after inverter 100 begins to operate, the voltage across capacitor 706 reaches a predetermined trigger voltage (i.e., the "breakover" voltage of diac 708; e.g., 32 volts) and diac 708 turns on and couples third node 704 to gate terminal 612 of FET 610 via resistor 710. Consequently, FET 610 turns on. Once FET 610 turns on, third node 704 is coupled to circuit ground via diode 720, so the voltage at third node 704 drops to near zero. Diac 708 turns off and remains off for at least as long as FET 610 remains on. If FET 610 is subsequently turned off, the preceding turn-on cycle will repeat itself, and FET 610 will be turned on again after about one second.

Turn-on circuit 700 may be implemented using any other type of circuit that periodically provides a pulse of limited duration for turning on switch 610 for a limited period of time. For example, although not shown or described in detail herein, turn-on circuit 700 may be implemented using an appropriate timer circuit that delays providing a pulse for a fixed period of time after inverter 100 begins to operate (i.e., so that proper filament preheating is provided) and after occurrence of a fault condition (i.e., so that automatic relamping capability is provided).

As a consequence of using the diac-based turn-on circuit 700 shown in FIG. 4, it is preferred that switching circuit 600 further include a first diode 640 and a second diode 650. First diode 640 has an anode 642 coupled to the second end 624 of capacitor 620 and a cathode 644 coupled to the drain terminal 614 of FET 610. Second diode 650 has an anode 652 coupled to circuit ground 50 and a cathode 654 coupled to the second end 624 of capacitor 620. The function of second diode 650 is, when FET 610 is on, to provide a circuit path for the negative half-cycles of the high frequency current that flows through resonant capacitor 204. Note that second diode 650 is only required because of the presence of first diode 640 (which, in turn, is only required because of diode 720 in turn-on circuit 700). If a different type of turn-on circuit is used, diode 640 may not be required and second end 624 of capacitor 620 may be connected directly to the drain terminal 614 of FET 610, in which case the built-in drain-to-source diode (not shown) of FET 610 would serve the same function as diode 650.

A prototype ballast configured substantially as depicted in FIG. 4 was built and tested. $V_{DC}$ was set to 350 volts, the inverter operating frequency was set at approximately 48 kilohertz, and the following component values and part numbers were used:

Inductor 202: 2,8 millihenries

Capacitor 204: 3.9 nanofarads, 1.4 kilovolt

Capacitor 214: 0.1 microfarads, 400 volts

Transformer 400:

Primary winding 402: 150 turns (inductance=25 millihenries)

Auxiliary windings 404,406: 5 turns each

Switching circuit 600:

FET 610: 4N60

Capacitor 620: 0.1 microfarads, 400 volts

Diode 630: RGP10J

Diode 640: RGP10J

Diode 650: RGP10J

Zener diode 660: 1N4740A (zener voltage=10 volts)

Turn-on circuit 700:

Resistor 702: 440 kilohms (two—220 kilohm, ¼ watt resistors in series)

Capacitor 706: 1 microfarad, 50 volts

Diac 708: breakover voltage=32 volts

Resistor 710: 30 ohms, ¼ watt

Diode 720: 1N4007

Lamp-out detection circuit 800:

Capacitor 802: 0.0047 microfarads, 400 volts

Diode 810: 1N4148

Diode 820: 1N4148

Capacitor 830: 0.047 microfarad, 50 volts

Resistor 832: 20 kilohms, ¼ watt

Figure 5:
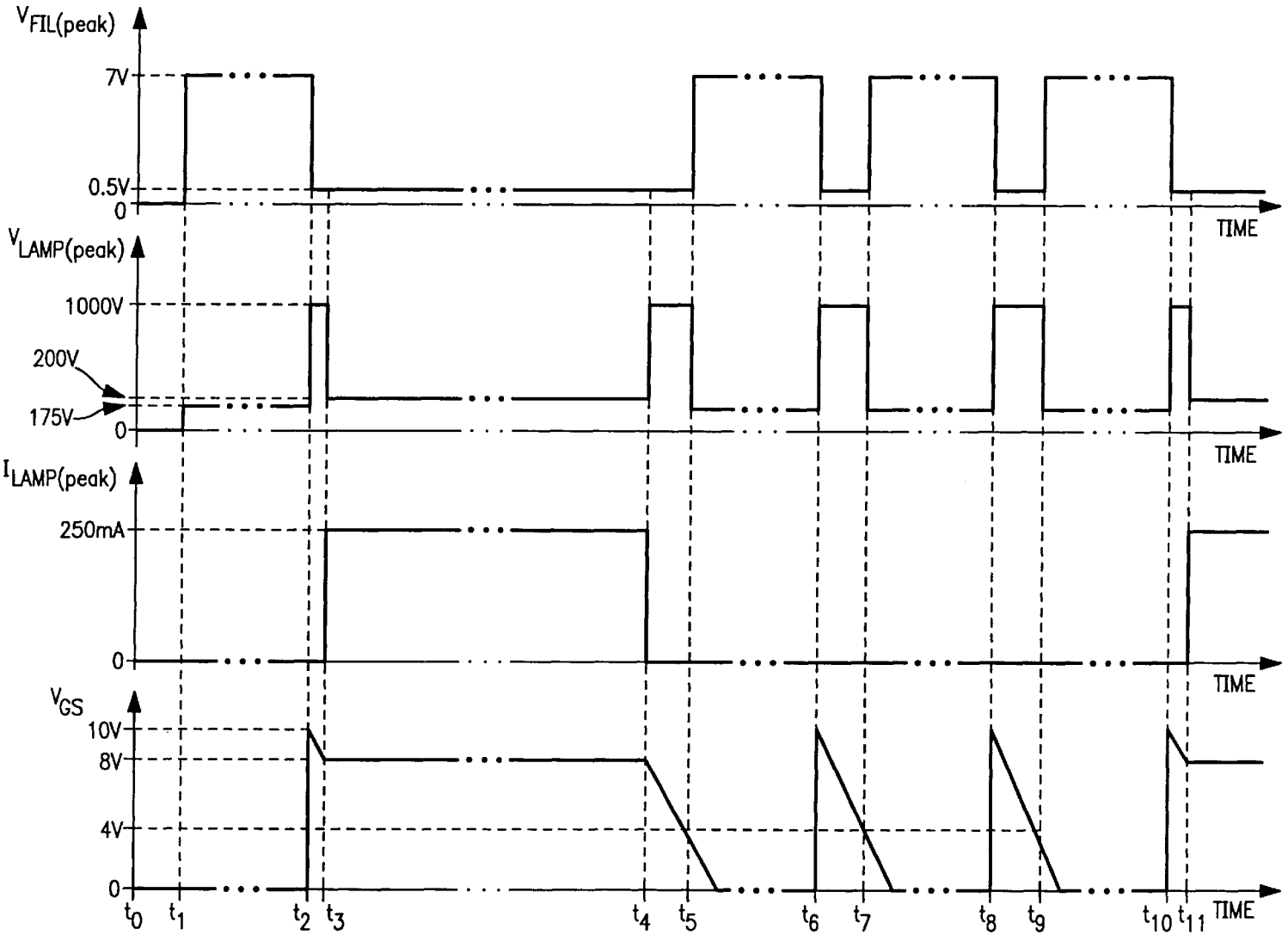
FIG. 5 includes several approximate waveforms that describe the detailed operation of the filament heating and protection circuit, in accordance with a preferred embodiment of the present invention.

The detailed operation of ballast 10 is now explained with reference to FIGS. 4 and 5 as follows. In FIG. 5, $V_{FIL}$ represents the voltage across each filament 22,24 of lamp 20; that is, $V_{FIL}$ represents both the voltage between output connection 206 and output connection 208, and the voltage between output connection 210 and output connection 212. $V_{LAMP}$ is the voltage that is applied between opposing ends of lamp 20; for example, $V_{LAMP}$ may be thought of as the voltage between output connection 206 and output connection 212. $I_{LAMP}$ is the actual current that flows in the arc of the lamp when the lamp is ignited. $V_{GS}$ is the gate-to-source voltage (i.e., the voltage between gate terminal 612 and source terminal 616) of FET 610. For purposes of clarity and ease of explanation, the waveforms in FIG. 5 are, in at least some instances, simplified approximations of the waveforms that would actually be observed on an oscilloscope during operation of ballast 10. For example, each of $V_{FIL}$, $V_{LAMP}$, and $I_{LAMP}$ are depicted in terms of the peak values of the actual signal; in reality, each of these signals is an alternating current (AC) signal that symmetrically varies between negative and positive values. Additionally, FIG. 5 depicts several abrupt transitions in value that would not necessarily occur in so orderly a manner in the actual ballast, where a certain degree of transient behavior is typical. Finally, the time-scale of the waveforms in FIG. 5 is compressed in a number of instances (i.e., as denoted by ". . .") in order to better illustrate what occurs within each ignition cycle (i.e., $t_2$ to $t_3$, $t_4$ to $t_5$, $t_6$ to $t_7$, and so forth).

At time $t_0$, power is applied to the ballast. Because the inverter has not yet started to operate, $V_{FIL}$, $V_{LAMP}$, $I_{LAMP}$, and $V_{GS}$ are all initially at zero.

At time $t_1$, which typically occurs within less than 0.5 seconds after time $t_0$, inverter 100 begins to operate and provide a substantially squarewave output voltage having a frequency at or near the natural resonant frequency (e.g., 48 kilohertz) of resonant inductor 202 and resonant capacitor 204. Within turn-on circuit 700, capacitor 706 begins to charge up though resistor 702. Because FET 610 is still off at this point, almost all of the current flowing through resonant capacitor 204 also flows through primary winding 402; although diode 650 and capacitor 620 initially provide a path for negative-going current, that path quickly becomes insignificant once capacitor 620 peak charges to $V_{DC}/2$ in the negative direction (i.e., +sign at 624, –sign at 622). The inductance of primary winding 402 is significant enough relative to that of resonant inductor 202 to prevent inductor 202 and capacitor 204 from developing the high voltages that otherwise appear across each when first node 220 is AC coupled to circuit ground 50.

During the period between $t_1$, and $t_2$, $V_{FIL}$ is at a relatively high level (e.g., 7 volts). In contrast, $V_{LAMP}$ is at a relatively low level (e.g., 175 volts) that is not only insufficient to ignite the lamp, but that is also low enough so that little glow current flows through the lamp. $I_{LAMP}$ is still at zero because the lamp has not yet ignited. Finally, $V_{GS}$ is at zero because diac 708 in turn-on circuit 700 has not yet turned on.

At time $t_2$, the voltage across capacitor 706 reaches the breakover voltage (e.g., 32 volts) of diac 704. Consequently, diac 720 turns on and current flows out of capacitor 706 and into resistor 832 and capacitor 830 via resistor 710. Because of this current, the voltage at gate terminal 612 rapidly reaches a value that exceeds the minimum turn-on voltage (e.g., 4 volts) of FET 610, so FET 610 turns on. Zener diode 660 limits the voltage at gate terminal 612 to a safe value (e.g., 10 volts) in order to prevent damage to FET 610. With FET 610 now on, diode 720 becomes forward-biased and capacitor 706 rapidly discharges to circuit ground via FET 610. Diac 708 thus turns off because the voltage across capacitor 706 has fallen below the sustaining voltage (e.g., 28 volts) of the diac. With FET 610 on, node 220 is AC coupled to circuit ground 50 via capacitor 620, diode 640, and FET 610. Because capacitor 620 has a capacitance that is at least an order of magnitude larger than that of resonant capacitor 204, and an impedance that is substantially smaller than the impedance of primary winding 402, almost all of the high frequency current that flows through resonant capacitor 204 bypasses primary winding 402 and flows to ground via capacitor 620 and: (i) diode 640 and FET 610 (for the positive half cycles); or (ii) diode 650 (for the negative half cycles). As a result, the voltage across primary winding 402 is greatly reduced and, correspondingly, $V_{FIL}$ is greatly reduced (e.g., from 7 volts down to 1 volt or less). At the same time, $V_{LAMP}$ increases dramatically (e.g., from 175 volts to 1000 volts) because the effective AC short across primary winding 402 allows resonant inductor 202 and resonant capacitor 204 to behave substantially as a conventional series resonant circuit that is excited at or near its resonant frequency. In this way, ballast 10 initially provides a high filament voltage for preheating the lamp filaments, then reduces the filament preheating voltage and provides a high voltage for attempting to ignite the lamp.

Between $t_2$ and $t_3$, with diac 708 off and capacitor 706 discharged, FET 612 remains on because the voltage across capacitor 830 exceeds the minimum turn-on voltage of the FET. Although FET 610 requires little current to remain on, $V_{GS}$ nonetheless decreases because capacitor 830 discharges into resistor 832.

At time $t_3$, lamp 20 ignites and thus begins to conduct current. $V_{LAMP}$ rapidly falls to about 200 volts (the typical peak voltage across an F32T8 lamp operated at rated current) because the ignited lamp presents a substantial load to the resonant circuit. With lamp 20 now operating, a small amount of AC current flows into lamp-out detection circuit 800 and through capacitor 802. Diode 820 allows only positive-going current to pass through to capacitor 830. Diode 810 allows negative-going current to flow up from circuit ground 50 and back through capacitor 802, thereby preventing capacitor 802 from peak-charging so that it can continue to provide AC coupling. The component values for capacitors 803,830 and resistor 832 are selected such that the substantially DC voltage across capacitor 830 will be an appropriate value (e.g., 8 volts) for safely keeping FET 610 turned on. The function of resistor 832 is to discharge capacitor 830, and thus turn FET 610 off, within a limited period of time (i.e., less than one millisecond) in the event of a lamp fault. The resistance of resistor 832 should be large enough relative to the capacitance of capacitor 830 to ensure that FET 610 will remain on for at least long enough a time to achieve ignition of an operable lamp; once the lamp ignites, capacitor 830 will be replenished by a small portion of the lamp current via capacitor 802 and diode 820. On the other hand, to ensure fast response to a lamp fault, resistor 832 should have a resistance that is small enough relative to the capacitance of capacitor 830 in order to cause $V_{GS}$ to fall to less than the minimum turn-on voltage (e.g., 4 volts) of the FET within less than one millisecond after capacitor 830 ceases to be replenished via capacitor 802 and diode 820.

Between $t_3$ and $t_4$, lamp 20 operates normally and $V_{GS}$ remains at a level (e.g., 8 volts) that keeps FET 610 on. During this time, $V_{FIL}$ remains at a low level (e.g., 0.5 volts or less), so very little power is expended on heating the lamp filaments. In applications where the lamp is operated with a lower value of $I_{LAMP}$, it might be desirable to actually increase the operating value of $V_{FIL}$ during this period in order to ensure proper filament temperature. Such an increase can be accomplished, within limits, merely by selecting a smaller capacitance for capacitor 620. However, the capacitance of capacitor 620 should not be decreased to the point of becoming comparable to (e.g., less than ten times) that of resonant capacitor 204, as that would likely affect the resonant circuit and possibly reduce the ignition voltage.

It is assumed that, at time $t_4$, the lamp is either removed or the lamp suddenly fails to conduct current. As a result of removal of the lamp load, $V_{LAMP}$ increases to its ignition level. Because $I_{LAMP}$ is now zero, no current flows into capacitor 802 in order to maintain the voltage across capacitor 830 at its operating level of about 8 volts. Capacitor 830 discharges through resistor 832 and $V_{GS}$ begins to decrease.

At time $t_5$, $V_{GS}$ finally falls below the level (e.g., 4 volts) necessary to keep FET 610 on, so FET 610 turns off. With FET 610 off, the approximate AC short across primary winding 402 is removed and primary winding 402 is again effectively in series with resonant capacitor 204. This causes $V_{LAMP}$ to fall to a relatively low level (e.g., 175 volts), and $V_{FIL}$ to return to its preheat level (e.g., 7 volts) because the voltage across primary winding 402 is now much greater than it was when FET 610 was on.

Beginning at time $t_5$, once FET 610 is turned off, diode 720 becomes reverse-biased and allows capacitor 706 to begin charging up through resistor 702. After time $t_5$, $V_{GS}$ continues to decrease and asymptotically approaches zero as capacitor 830 continues to discharge through resistor 832

At time $t_6$, which is approximately one second after time $t_5$, the voltage across capacitor 706 reaches the breakover voltage (e.g., 32 volts) of diac 708. Diac 708 turns on and causes FET 610 to turn on, in the same manner as previously described. With FET 610 on, primary winding 402 is effectively shunted, resonant inductor 202 and resonant capacitor 204 achieve resonant operation, $V_{LAMP}$ increases to its ignition level, and $V_{FIL}$ decreases from its preheat level to its operating level.

Between $t_6$ and $t_7$, which is a period of less than one millisecond, $V_{GS}$ continuously decreases from its initial value of 10 volts. Because the removed or failed lamp has yet to be replaced with a "good" lamp, lamp ignition cannot occur. Absent an operating lamp, no sustaining current is provided to lamp-out detection circuit 800, and $V_{GS}$ thus continues to decrease.

At time $t_7$, which occurs within one millisecond after time $t_6$, $V_{GS}$ falls below 4 volts and FET 610 turns off. $V_{LAMP}$ returns its lower level and $V_{FIL}$ returns to its preheat level, where both remain until the next ignition cycle commences about one second later at time $t_8$.

Assuming that the lamp fault is not cured, the ignition cycle that occurs between $t_8$ and $t_9$ will proceed in exactly the same way as previously described for the cycle between $t_6$ and $t_7$. The ballast will continue to provide periodic ignition cycles until at least such time as the lamp fault is cured or ballast power is removed. Advantageously, because each ignition cycle has a duration of less than one millisecond, and the time between successive ignition cycles is about one second, the average power dissipated in the ballast will be very low during a lamp fault condition.

If the lamp is replaced at some time between $t_9$ and $t_{10}$, the replaced lamp will be successfully ignited during the ignition cycle that occurs between $t_{10}$ and $t_{11}$, in the same manner as previously described with regard to the ignition cycle that occurs between $t_2$ and $t_3$. In this way, ballast 10 provides for automatic ignition upon replacement of a failed or removed lamp.

Ballast 10 offers a number of significant advantages over prior approaches. Ballast 10 employs a filament heating and protection circuit that requires only a modest amount of electrical circuitry, but that provides a number of functional benefits. First, ballast 10 offers a substantial savings in energy consumption by minimizing unnecessary heating of lamp filaments during normal operation of the lamp(s). Second, ballast 10 provides an abrupt ignition voltage at a high level that quickly produces full arc current, thus enhancing the useful life of the lamp while also providing superior "cold starting" capability. Additionally, ballast 10 includes inherent protection that prevents excessive voltages, currents, and power dissipation in the event of lamp removal or failure. Ballast 10 also accommodates relamping, as it provides for automatic ignition of a replaced lamp. Further, ballast 10 is easily modified (i.e., by reducing the capacitance of capacitor 620; see FIG. 4) so as to provide at least some level of filament heating, if desired. The result is a reliable, cost-effective ballast that operates lamps in an energy-efficient and life-preserving manner.

Although the present invention has been described with reference to certain preferred embodiments, numerous modifications and variations can be made by those skilled in the art without departing from the novel spirit and scope of this invention. For example, although the drawings refer to a ballast with a single gas discharge lamp, it should be understood that the present invention is equally applicable to ballasts that power multiple lamps. Moreover, although it is believed that use of a FET in the switching circuit constitutes a best mode of practicing the present invention, the use of other controllable switching devices, such as a bipolar junction transistor or an electromechanical relay, has also been contemplated as a design option that falls within the scope of certain of the appended claims.

What is claimed is:

1. A ballast for powering at least one gas discharge lamp having heatable filaments, comprising:

an inverter having a pair of inputs and an output, and operable to receive a substantially direct current (DC) voltage and to provide an alternating voltage at the inverter output;

first, second, third, and fourth output connections adapted for connection to the lamp, wherein the first and second output connections are coupled to a first filament of the lamp, and the third and fourth output connections are coupled to a second filament of the lamp;

a resonant inductor coupled between the inverter output and the first output connection;

a resonant capacitor coupled between the first output connection and a first node;

a direct current (DC) blocking capacitor coupled between the fourth output connection and circuit ground;

a filament heating and protection circuit coupled to the first node and the first, second, third, and fourth output connections, and operable to provide:

(i) a filament preheating mode wherein a voltage across each filament is maintained at a preheat level, and a voltage between the first and fourth output connections is maintained at a pre-ignition level, in order to preheat the filaments prior to attempting to ignite the lamp;

(ii) an ignition mode wherein the voltage between the first and fourth output connections is increased to an ignition level that is greater than the pre-ignition level;

(iii) a normal operating mode wherein the voltage across each filament is maintained at an operating level that is substantially less than the preheat level; and (iv) a fault mode wherein the filament preheating mode and the ignition mode are repeated in response to a lamp fault condition.

2. The ballast of claim 1, wherein a lamp fault condition is deemed to have occurred for at least one of:

(a) disconnection of the lamp; and (b) failure of the lamp to ignite and conduct current following completion of the ignition mode.

3. The ballast of claim 1, wherein a lamp fault condition is deemed to have occurred for each of:

(a) disconnection of the lamp; and (b) failure of the lamp to ignite and conduct current in following completion of the ignition mode.

4. The ballast of claim 1, wherein the filament heating and protection circuit comprises:

a transformer, comprising:

a primary winding coupled between the first node and circuit ground;

a first auxiliary winding coupled to the first and second output connections; and a second auxiliary winding coupled to the third and fourth output connections;

a control circuit coupled to the first node, the fourth output connection, and circuit ground, and operable to selectively provide a low impedance alternating current (AC) path between the first node and circuit ground, wherein:

(i) during the ignition and normal operating modes, a low impedance AC path is provided between the first node and circuit ground; and (ii) during the filament preheating mode, a low impedance AC path is not provided between the first node and circuit ground.

5. The ballast of claim 4, wherein the control circuit comprises:

a switching circuit coupled between the first node and circuit ground and operable to selectively turn on and provide a low impedance AC path between the first node and circuit ground;

a turn-on circuit coupled to the switching circuit and operable to turn the switching circuit on during the ignition mode following completion of the preheating mode; and a lamp-out detection circuit coupled to the fourth output connection and the switching circuit and operable to keep the switching circuit on during the normal operating mode, and to turn the switching circuit off in response to a lamp fault condition.

6. The ballast of claim 5, wherein the switching circuit comprises a switch having a control terminal, a first conduction terminal coupled to the first node, and a second conduction terminal coupled to circuit ground.

7. The ballast of claim 6, wherein:

the switch comprises a field-effect transistor (FET) having a drain terminal, a source terminal, and a gate terminal, wherein the gate terminal is the control terminal, the drain terminal is the first conduction terminal, and the source terminal is the second conduction terminal;

the switching circuit further comprises a first capacitor having a first end coupled to the first node and a second end coupled to the drain terminal of the FET.

8. The ballast of claim 7, wherein the switching circuit further comprises a clamp diode having an anode coupled to the drain terminal of the FET and a cathode coupled to a first input of the inverter.

9. The ballast of claim 5, wherein the lamp-out detection circuit is operable to turn the switching circuit off within less than one millisecond after occurrence of a lamp fault condition.

10. The ballast of claim 5, wherein the lamp-out detection circuit comprises:

a first capacitor coupled between the fourth output connection and a second node;

a first diode having an anode coupled to circuit ground and a cathode coupled to the second node;

a second diode having an anode coupled to the second node and a cathode coupled to the control terminal of the switch;

a second capacitor coupled between the control terminal of the switch and circuit ground; and a resistor coupled between the control terminal of the switch and circuit ground.

11. The ballast of claim 6, wherein the turn-on circuit is operable to periodically provide a pulse of limited duration for turning on the switch for a limited period of time.

12. The ballast of claim 7, wherein:

the turn-on circuit comprises:

a first resistor coupled between the inverter output and a second node;

a second capacitor coupled between the second node and circuit ground;

a voltage-triggered device coupled between the second node and the gate terminal of the FET, and operable to turn on and couple the second node to the gate terminal in response to the voltage across the second capacitor reaching a predetermined trigger voltage;

a second resistor interposed between the voltage-triggered device and the gate terminal of the FET; and a first diode having an anode coupled to the second node and a cathode coupled to the drain terminal of the FET; and the switching circuit further comprises:

a second diode having an anode coupled to the second end of the first capacitor, and a cathode coupled to the drain terminal of the FET; and a third diode having an anode coupled to circuit ground and a cathode coupled to the second end of the first capacitor.

13. A ballast for powering at least one gas discharge lamp having heatable filaments, comprising:

an inverter having an inverter output and operable to provide a voltage at the inverter output, the voltage having a frequency;

first, second, third, and fourth output connections for connection to gas discharge lamp, wherein the first and second output connections are adapted for connection to a first filament of the lamp, and the third and fourth output connections are adapted for connection to a second filament of the lamp;

a resonant inductor coupled between the inverter output and the first output connection;

a resonant capacitor coupled between the first output connection and a first node, wherein the resonant inductor and the resonant capacitor have a natural resonant frequency at or near the frequency of the voltage at the inverter output;

a transformer, comprising:

a primary winding coupled between the first node and circuit ground;

a first auxiliary winding coupled to the first and second output connections;

a second auxiliary winding coupled to the third and fourth output connections;

a direct current (DC) blocking capacitor coupled between the fourth output connection and circuit ground; and a control circuit coupled to the first node and the fourth output connection, wherein the control circuit is operable to provide:

(i) a filament preheating mode wherein, following application of power to the ballast, a voltage across the primary winding of the transformer assumes a first value for a predetermined preheating period;

(ii) an ignition mode wherein, after the filaments have been preheated for the predetermined preheating period, the first node is coupled to circuit ground via a low impedance alternating current (AC) path and the voltage between the first and fourth output connections is momentarily increased in order to ignite the lamp;

(iii) a normal operating mode wherein, if the lamp ignites and conducts current in a substantially normal manner within a predetermined ignition period following completion of the preheating period, the first node remains coupled to circuit ground via the low impedance AC path for as long as the lamp continues to conduct current in a substantially normal manner, wherein the voltage across the primary winding is maintained at a second value that is substantially less than the first value in order to conserve power expended on heating the filaments; and (iv) a fault mode wherein the filament preheating mode and the ignition mode are repeated in response to a lamp fault condition, wherein a lamp fault condition is deemed to have occurred for each of:

(a) removal of the lamp; and (b) failure of the lamp to ignite and conduct current following completion of the ignition mode.

14. The ballast of claim 13, wherein the control circuit comprises:

a switching circuit coupled between the first node and circuit ground and operable to selectively turn on and provide a low impedance AC path between the first node to circuit ground;

a turn-on circuit coupled to the switching circuit and operable to turn on the switching circuit during the ignition mode following completion of the preheating mode; and a lamp-out detection circuit coupled to the fourth output connection and the switching circuit and operable to keep the switching circuit on during the normal operating mode, and to turn the switching circuit off in response to a lamp fault condition.

15. The ballast of claim 14, wherein the switching circuit comprises a switch having a control terminal, a first conduction terminal coupled to the first node, and a second conduction terminal coupled to circuit ground.

16. The ballast of claim 15, wherein the switch comprises a field-effect transistor (FET) having a drain terminal, a source terminal, and a gate terminal, wherein the gate terminal is the control terminal, the drain terminal is the first conduction terminal, and the source terminal is the second conduction terminal.

17. The ballast of claim 15, wherein the lamp-out detection circuit is operable to turn the switch off within less than one millisecond after occurrence of a lamp fault condition.

18. The ballast of claim 15, wherein the lamp-out detection circuit comprises:

a first capacitor coupled between the fourth output connection and a second node;

a first diode having an anode coupled to circuit ground and a cathode coupled to the second node;

a second diode having an anode coupled to the second node and a cathode coupled to the control terminal of the switch;

a second capacitor coupled between the control terminal of the switch and circuit ground; and a resistor coupled between the control terminal of the switch and circuit ground.

19. The ballast of claim 16, wherein:

the turn-on circuit comprises;

a resistor coupled between the inverter output and a second node;

a first capacitor coupled between the second node and circuit ground;

a voltage-triggered device coupled between the second node and the gate terminal of the FET, and operable to turn on and couple the second node to the gate terminal in response to the voltage across the first capacitor reaching a predetermined trigger voltage; and a first diode having an anode coupled to the second node and a cathode coupled to the drain terminal of the FET; and the switching circuit further comprises:

a second capacitor having a first end and a second end, wherein the first end is coupled to the first node;

a second diode having an anode coupled to the second end of the second capacitor, and a cathode coupled to the drain terminal of the FET;

a third diode having an anode coupled to circuit ground and a cathode coupled to the second end of the second capacitor; and a clamping diode having an anode coupled to the drain terminal of the FTE and a cathode coupled to a first input of the inverter.

20. A ballast for powering at least one gas discharge lamp having a pair of heatable filaments, comprising:

an inverter having an inverter input and an inverter output, and operable to provide a high frequency voltage at the inverter output;

first, second, third, and fourth output connections for connection to the gas discharge lamp, wherein:

the first and second output connections are adapted for connection to a first filament of the lamp; and the third and fourth output connections are adapted for connection to a second filament of the lamp;

a resonant inductor coupled between the inverter output and the first output connection;

a resonant capacitor coupled between the first output connection and a first node;

a transformer, comprising:

a primary winding coupled between the first node and circuit ground;

a first auxiliary winding coupled to the first and second output connections;

a second auxiliary winding coupled to the third and fourth output connections;

a direct current (DC) blocking capacitor coupled between the fourth output connection and circuit ground;

a switching circuit, comprising;

a switch having a control terminal, a first conduction terminal coupled to the first node, and a second conduction terminal coupled to circuit ground; and a clamping diode having an anode coupled to the first conduction terminal of the switch and a cathode coupled to the inverter input;

a lamp-out detection circuit, comprising:

a first capacitor coupled between the fourth output connection and a second node;

a fist diode having an anode coupled to circuit ground and a cathode coupled to the second node;

a second diode having an anode coupled to the second node and a cathode coupled to the control terminal of the switch;

a second capacitor coupled between the control terminal of the switch and circuit ground; and a resistor coupled between the control terminal of the switch and circuit ground; and a turn-on circuit, comprising:

a turn-on resistor coupled between the inverter output and a third node;

a turn-on capacitor coupled between the third node and circuit ground;

a voltage-triggered device coupled between the third node and the control terminal of the switch, and operable to turn on and couple the third node to the control terminal in response to the voltage across the turn-on capacitor reaching a predetermined trigger voltage; and a reset diode having an anode coupled to the third node and a cathode coupled to the fist conduction terminal of the switch.

* * * * *